US005136556A

United States Patent [19]

Obara

[11] Patent Number: 5,136,556

[45] Date of Patent: Aug. 4, 1992

[54] WIDE BANDWIDTH BARREL STAVE PROJECTOR

[75] Inventor: Robert J. Obara, Portsmouth, R.I.

[73] Assignee: The Unites States of America as represented by the Secretary of the Navy, Washington, D.C.

[21] Appl. No.: 783,663

[22] Filed: Oct. 28, 1991

[51] Int. Cl.[5] ..... H01V 7/00

[52] U.S. Cl. ..... 367/163; 367/158; 310/337

[58] Field of Search ..... 310/337; 367/155, 157, 367/158, 159, 165, 166, 163

[56] References Cited

U.S. PATENT DOCUMENTS 4,922,470 5/1990 McMahon et al. ..... 367/163
5,030,873 7/1991 Owen ..... 310/337

*Primary Examiner*—Brian S. Steinberger

*Attorney, Agent, or Firm*—Michael J. McGowan; Prithvi C. Lall; Michael F. Oglo

[57] ABSTRACT

An underwater acoustical projector has its barrel staves located radially outward of a piezoelectric ceramic driver. The barrel staves are in an hour glass arrangement. The cross-sectional arrangement of the barrel staves is circular at both the top and bottom of the hour glass forming elliptical cross-sections of varying eccentricity between said top and bottom of said staves. The cross-section of greatest eccentricity is located midway between the top and bottom of said staves. The cross-section of greatest eccentricity is located midway between the top and bottom of the barrel staves. This forms a projector with a varying radius of curvature in each of the four 90° quadrants around the axis of the projector. This yields large changes in the resonant frequency.

7 Claims, 1 Drawing Sheet

WIDE BANDWIDTH BARREL STAVE PROJECTOR

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to sound radiation. More particularly it concerns an improvement in an underwater barrel stave acoustical projector that has use as a mobile target capable of simulating the spatial extent of a submarine. The barrel stave projector is a flextensional device that drives a series of concave staves in the radial direction by the application of a force in the axial direction produced by a stack of piezoelectric ceramic rings in response to an electrical input. Thus, the projector essentially operates as a mechanical amplifier, coupling the longitudinal vibration of a piezoceramic driver to the transverse vibration of a passive shell comprised of a plurality of barrel staves.

(2) Description of the Prior Art

In prior art systems a barrel stave projector used identical staves made of curved flexible bars arranged so that the profile of the projector is similar to an hourglass which is circular in horizontal cross-section at all points from the top to the bottom thereof. This configuration provided a very limited range of resonant frequency for such a projector.

SUMMARY OF THE INVENTION

Accordingly, it is a general purpose and object of the present invention to provide an improved flextensional device for simulating the active characteristics of submarines. It is a further object that the device has a broad range of frequencies. An additional object is that the device be capable of being towed underwater as part of an array of projectors.

These objects are accomplished with the present invention by modifying a typical barrel stave projector that is suitable for underwater use by varying the radius of curvature of the staves so that a different type of hourglass shape is formed by the arrangement of the staves. The hourglass formed in subject device has a circular cross-section along the horizontal planes at the top and bottom thereof and has an elliptical cross-section along the horizontal planes through points between the top and the bottom. The elliptical horizonal cross-section at the midway point has the highest value of eccentricity.

DESCRIPTION OF THE PREFERRED EMBODIMENT

Figure 1:
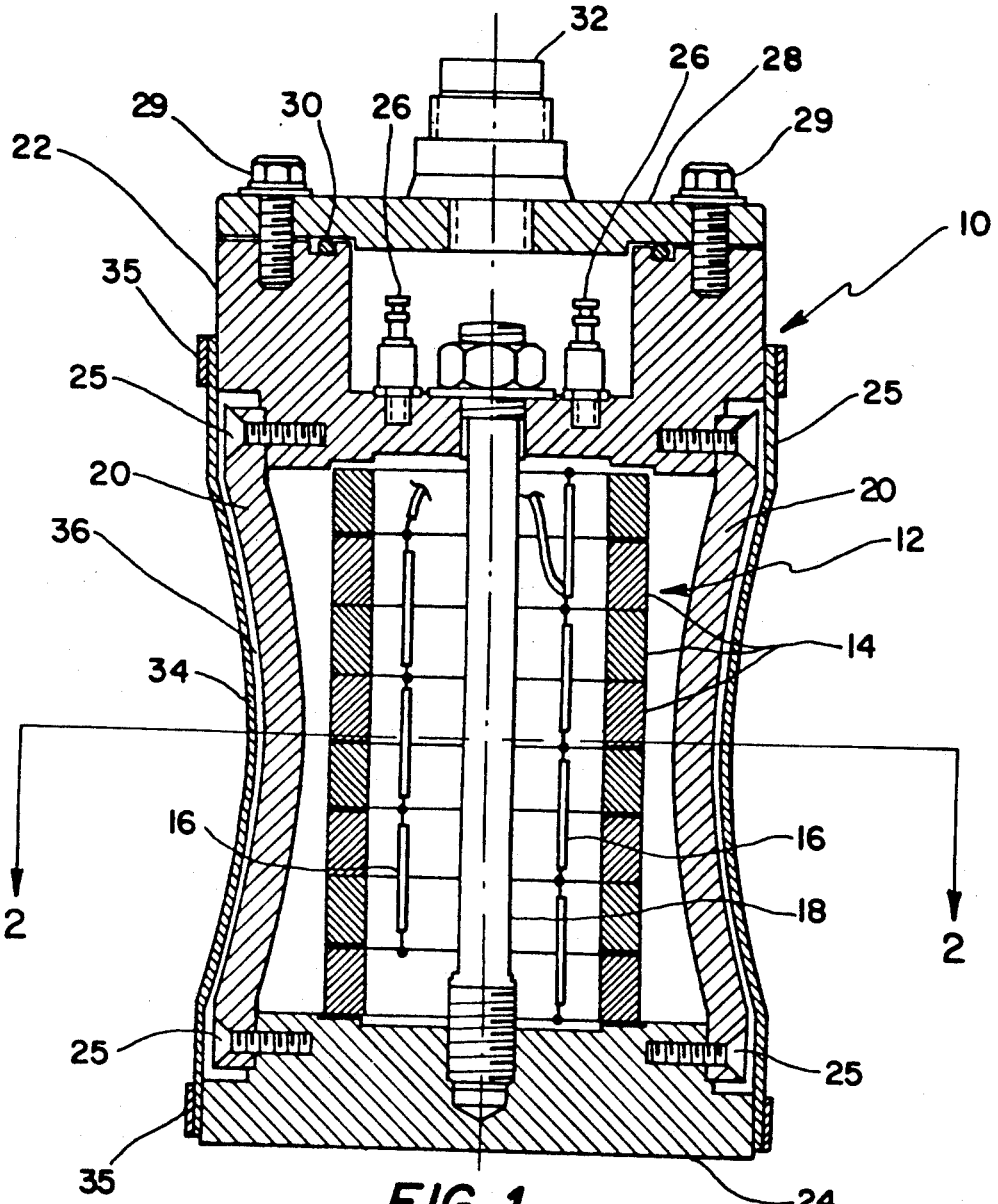
FIG. 1 is a cross-sectional view of a barrel stave projector in accordance with the present invention.

Referring now to FIG. 1 there is shown a cross-sectional view of a barrel stave projector 10. A piezoelectric ceramic stack 12 is comprised of a plurality of elements 14. The number of elements 14 and their diameter can vary. Electrical leads 16 are connected to the elements 14. A stress bolt 18 is used to ensure that the stack 12 is never subject to tensile stresses. The projector 10 has a full complement of eight staves 20 mounted on upper and lower octagonal end caps 22 and 24, respectively by means of screws 25. The stress bolt 18 passes through the center of the elements 14 holding the end caps 22, 24, in place. The upper end cap 22 holds a pair of electrical terminals 26. A cover plate 28 is secured to upper end cap 22 by means of bolts 29. An O-ring seal 30 is secured between the cover plate 28 and the upper end cap 22. An electrical connector 32 that receives the electrical signals that are applied to the elements 14 is secured to cover plate 28. A rubber boot 34 is stretched over the staves 20 and bonded to the end caps 22, 24 with bands 35 to act as a seawater seal. A light coat of ethylene glycol 36 is used between the staves 20 and the boot 34 to eliminate trapped air.

Figure 2:
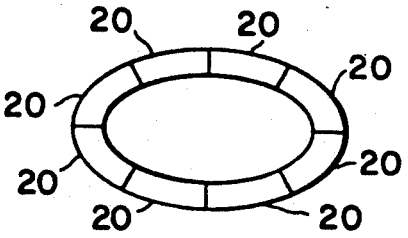
FIG. 2 is a view of the area of the staves taken along the line 2—2 of FIG. 1.
Figure 3:
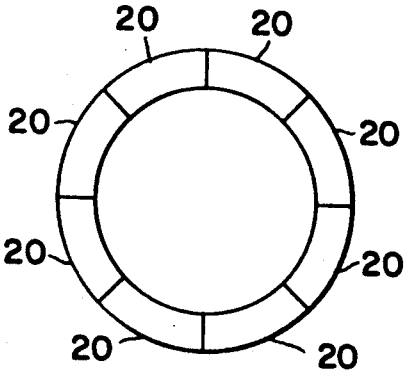
FIG. 3 is a view of the top and bottom surfaces of the staves of FIG. 1.

The assembly of staves in the projector 10 form an hour glass shape with the ends of the structure being circular in shape and the middle of the structure at its thinnest part forming an ellipse. This is shown in FIGS. 2 and 3. FIG. 2 taken along the line 2—2 of FIG. 1 shows the thinnest cross-sectional area to be elliptical. FIG. 3 shows the area of the top and bottom of the staves 20 to be circular. Elliptical cross-sections of varying eccentricity are formed at the horizontal planes between the top and bottom of the projector. The middle of the hour glass arrangement where the thinnest cross-section is located has the elliptical cross-section of largest eccentricity. The new projector has a wide bandwidth of resonant frequency for its operation.

There has therefore been described a barrel stave sound projector that has a radius of curvature that varies continuously between fixed values as the angle about the axis of the projector varies. This enables the projector to yield large changes in the range of resonant frequency.

It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. A barrel stave acoustical projector comprising:

at least one plate located at the top of said acoustical projector;

at least one plate located at the bottom of said acoustical projector;

a driver located between said at least one plate located at the top of said acoustical projector and said at least one plate located at the bottom of said projector;

electrical means for providing an electrical signal to said driver; and a plurality of staves forming an hourglass shape with the cross-sectional shape of the arrangement of said staves forming a circle at the top and bottom of said staves and elliptical cross sections of varying eccentricity between said top and bottom of said staves, said staves located radically outward of said driver, said staves are further arranged so that within said staves a plane orthogonal to the axis of the hourglass shape located a predetermined distance between said top and said bottom of said staves has both an area that is smaller than that in any other plane orthogonal to the axis of said hourglass shape and an elliptical eccentricity that is larger than that in any other plane orthogonal to the axis of said hourglass shape.

2. A barrel stave acoustical projector according to claim 1 wherein said plane having both said area that is smaller than that in any other plane orthogonal to the axis of said hourglass shape and said elliptical eccentricity that is larger than that in any other plane orthogonal to the axis of said hourglass shape being formed substantially equal distance between said top and bottom of said staves.

3. A barrel stave acoustical projector according to claim 2 wherein said driver further comprises a stack of piezoelectric ceramic disks.

4. A barrel stave acoustical projector according to claim 3 further comprising a stress bolt connected to said at least one plate located at the top of said acoustical projector and said at least one plate located at the bottom of said acoustical projector, said stress bolt extending through and being coaxial with said piezoelectric ceramic disks.

5. A barrel stave acoustical projector according to claim 4 further comprising a rubber boot extending over said staves and bonded to said at least one plate located at the top of said acoustical projector and said at least one plate located at the bottom of said acoustical projector.

6. A barrel stave acoustical projector according to claim 5 further comprising ethylene glycol being spread between said staves and said rubber boot.

7. A barrel stave acoustical projector according to claim 6 further comprising:

said at least one plate located at the top of said acoustical projector being an end cap and a cover; and an O-ring providing a water tight seal between said end cap and cover.

* * * * *